United States Patent [19]

Wieland

[11] Patent Number: 4,952,073

[45] Date of Patent: Aug. 28, 1990

[54] MATS CONVERTIBLE INTO A BAG

[76] Inventor: Karl W. Wieland, 41 Brimfield Rd., Norristown, Pa. 19403

[21] Appl. No.: 335,489

[22] Filed: Apr. 10, 1989

[51] Int. Cl.[5] ..... B65D 33/08; B65D 33/00

[52] U.S. Cl. ..... 383/4; 383/37; 273/336

[58] Field of Search ..... 273/336, 398, 400; 383/4, 37, 121

[56] References Cited

U.S. PATENT DOCUMENTS

| | | | |
|---|---|---|---|
| 1,172,204 | 2/1916 | Gerhardstein | 383/4 |
| 1,683,678 | 9/1928 | Kitterman et al. | 383/4 |
| 3,024,824 | 3/1962 | Bass | 383/4 |
| 4,314,702 | 2/1982 | Updike et al. | 273/336 |

*Primary Examiner*—Stephen P. Garbe

[57] ABSTRACT

A pair of mats to protect a lawn during a horseshoe game convertible into a bag for carrying horseshoe equipment and other items. The mats can also be converted separately to form two separate bags.

5 Claims, 2 Drawing Sheets

MATS CONVERTIBLE INTO A BAG

FIELD OF THE INVENTION

This invention relates to protective mats convertible into one or several carrying bags.

BACKGROUND OF THE INVENTION

Pitching horseshoes is an American tradition enjoyed by young and old. Although in some instances the game is played on a court which includes 2 clay-filled boxes for holding the stakes permanently, for most games the stakes are driven right into a lawn near a home or in a park.

During the course of a horseshoe game, the lawn around the stakes usually becomes devastated from the impact of horseshoes and from players standing near a stake when pitching.

Makeshift mats have been implemented to overcome this problem. However, such mats tend to become rumbled and they easily slip out of place.

Ordinary carrying bags are too short to hold horseshoe stakes, and they are not strong enough to carry the combined weight of horseshoes and stakes.

OBJECTS AND ADVANTAGES

The following are objects and advantages of the invention: to provide a pair of mats which will protect a lawn from horseshoe damage and which will not become rumbled or displaced during a horseshoe game, to provide a pair of mats which can be converted easily and quickly into one or two bags for carrying horseshoes, stakes etc. safely. Other objects and advantages of this invention will become apparent from the following description and accompanying drawings.

DRAWING REFERENCE NUMERALS

| | |
|---|---|
| 10 First Mat | 28 End Portion |
| 12 Larger Sheet | 30 Second Mat |
| 14 Panel | 32 Central Perforation |
| 16 Sides of Panel 14 | 34 Pin |
| 18 Ends of Panel 14 | 36 Groove |
| 20 Smaller Sheet | 38 Base of Pin 34 |
| 22 Ends of Sheet 20 | 40 Smaller Perforations |
| 24 Side Portions | 42 Cutouts |
| 26 End Portion | |

DETAILED DESCRIPTION OF THE PREFERRED EMBODIMENT

Figure 1:
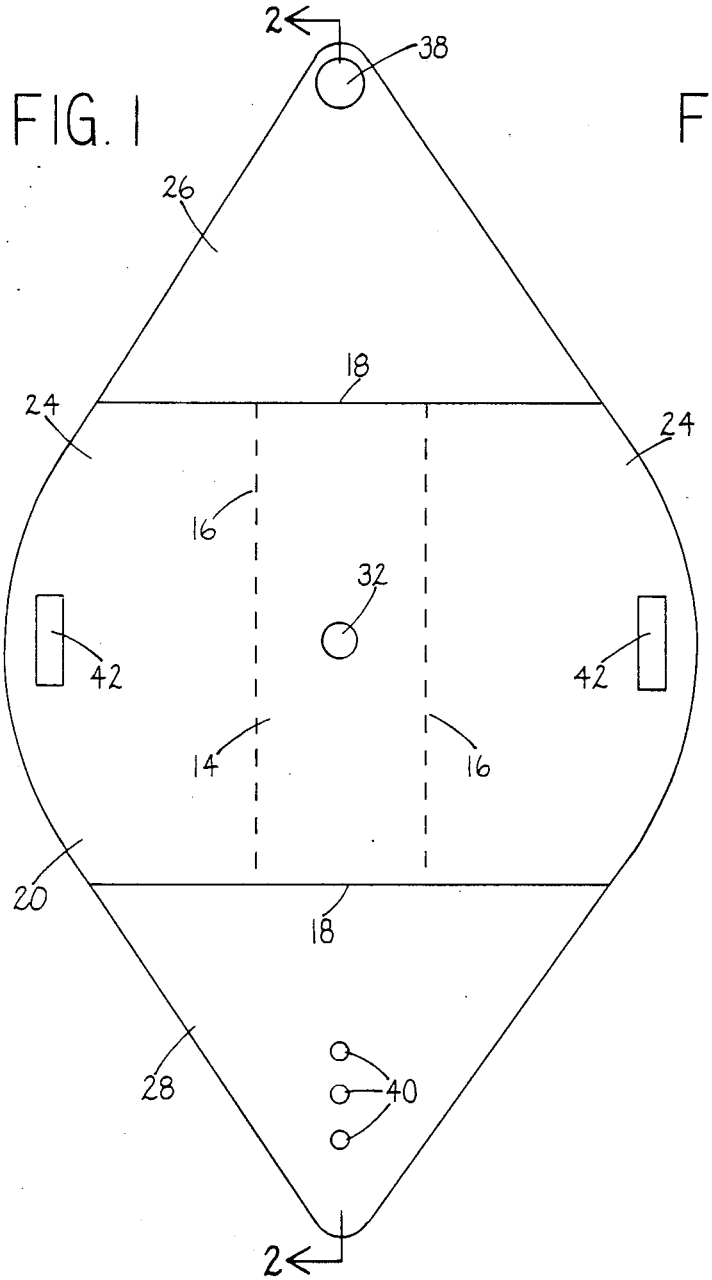
FIG. 1 shows a top plan view of mat 10 according to the invention.

Referring to FIG. 1, there is shown the first one of a pair of mats convertible into a carrying bag. First mat 10 comprises a generally diamond shaped larger sheet 12, preferably made of tough fabric. A thin rectangular shaped panel 14, made of strong rigid material having opposite sides 16 and ends 18 is bonded to the upper surface of sheet 12 at a central location, sides 16 being parallel with the longitudinal median line of sheet 12. A smaller sheet of fabric 20, having equal opposite ends 22 in alignment with ends 18, extends between the opposite perimetral edges of mat 10. Sheet 20 is bonded to the upper surface of panel 14 and to the upper surface of two equal opposite side portions 24 of sheet 12 adjacent opposite sides 16 by means of a semi rigid drying adhesive, thereby locking panel 14 in place and semi rigidifying side portions 24. Mat 10 includes 2 equal opposite end portions 26 and 28 adjacent opposite ends 22, extending between the opposite perimetral edges of mat 10.

Figure 2:
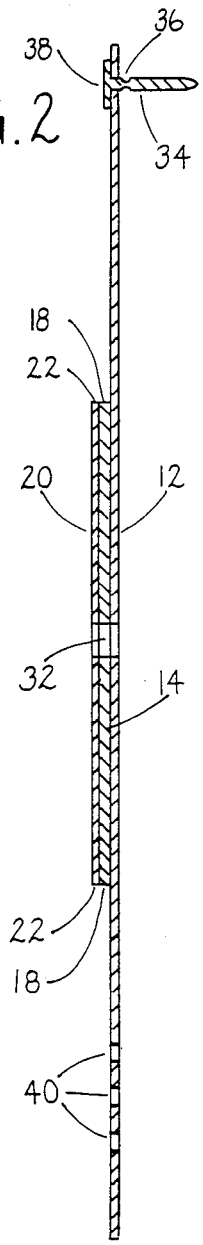
FIG. 2 shows a sectional view of mat 10 taken along the section line 2—2 of FIG. 1.
Figure 3:
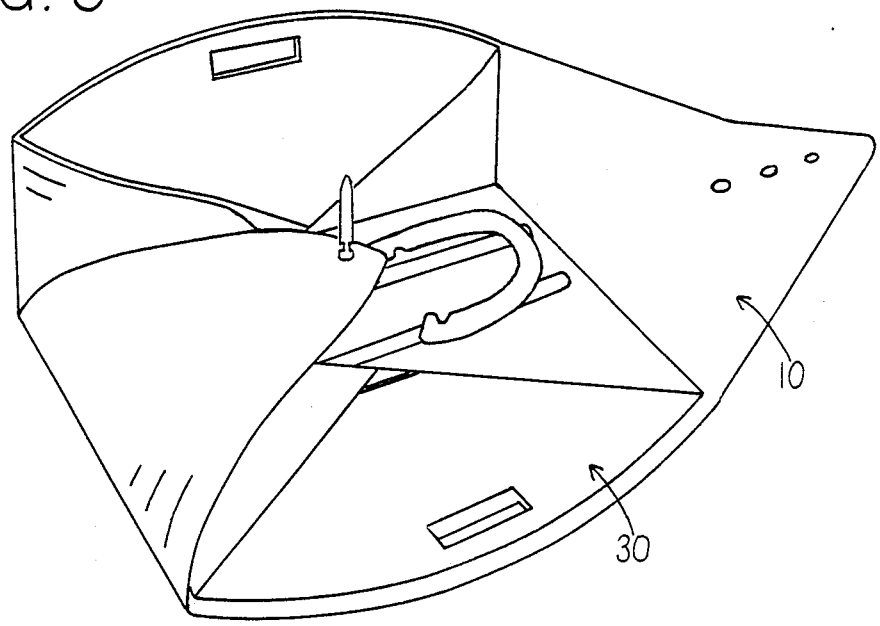
FIG. 3 is a perspective view of mat 30 superimposed over mat 10, mats 10 and 30 being partially converted into a carrying bag.
Figure 4:
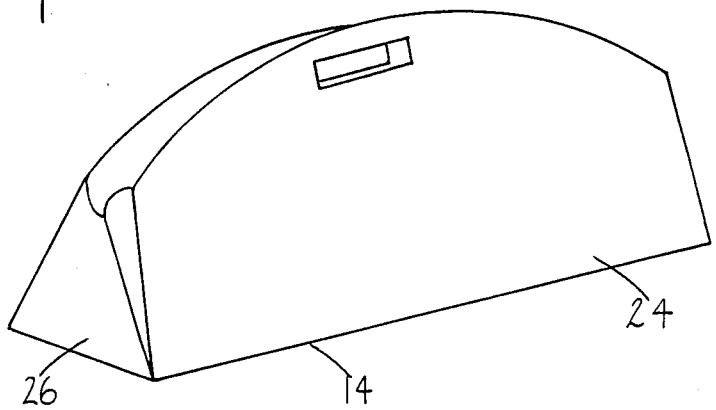
FIG. 4 shows mat 10 fully converted into a carrying bag.

A second mat 30 in FIG. 3 made and shaped similar to mat 10 has a smaller perimeter, a smaller panel 14 and smaller side portions 24 than mat 10. Mats 10 and 30 each include an equally shaped and sized centrally located larger perforation 32, FIGS. 1 and 2, to receive a horseshoe stake. A pin 34 in FIG. 2 is projecting from the lower surface of each end portion 26 at medial position adjacent the distal end thereof and in perpendicular relationship to end portion 26. Pin 34 includes a perimetral groove 36 adjacent end portion 26, and a mounting base 38, which may be secured to the upper surface of each end portion 26 by bonding or riveting. End portions 28 of mats 10 and 30 include a plurality of smaller perforations 40, located medially in spaced-apart relationship and sized to receive pin 34. Side portions 24 of mats 10 and 30 each include an equally shaped and sized elongate cutout 42 at medial position adjacent the perimeter edge of mats 10 and 30. Cutouts 42 and perforations 32 and 40 may be trimmed with grommets to prevent tearing of sheets 12 and 20.

In preparation for a horseshoe game, mats 10 and 30 are laid flat on a lawn, spaced apart at proper distance for insertion of horseshoe stakes through perforation 32 into the ground. With distal ends of mats 10 and 30 in alignment and end portions 26 aposition, pins 34 are pushed or driven into the ground to keep mats 10 and 30 aligned and flat on the ground to protect a lawn. After the game mats 10 and 30 may be converted into one carrying bag by superimposing mat 30 over mat 10 in FIG. 3, and turning end portions 26 and 28 of mat 30 upward and inward over panel 14 of mat 30. Horseshoes, stakes and other equipment can now be placed on end portions 26 and 28 of mat 30. End portion 26 of mat 10 is now to be turned upward and inward over the equipment. End portion 28 is subsequently turned over in similar fashion. Pin 34 is passed through the nearest perforation 40, locking a section of the perimetral edge of perforation 40 into groove 36, thereby securing the contents of the bag. Side portions 24 of mats 10 and 30 can now be grasped by cutouts 42 and raised simultaneously to form a single carrying bag.

Alternately, mats 10 and 30 may be converted into two separate bags, if a second bag is desirable for carrying clothing and refreshments e.g.

While the above description contains may specifications, these should not be construed as limitations on the scope of the invention. Other possible variations can be envisioned within it's scope.

I claim:

1. A pair of mats convertible into a bag consisting of a first mat and a second mat, each of said mats comprising:

a generally diamond shaped larger sheet of flexible material, a rectangular panel of rigid material having opposite sides and ends, said panel being connected to the upper surface of said larger sheet at a central location, said sides being parallel with a longitudinal median line of said larger sheet, a smaller sheet of flexible material having opposite ends in alignment with said ends of said panel, said smaller sheet extending between opposite perimetral edges of said larger sheet, said smaller sheet being connected to the upper surface of said panel and to the upper surface of two equal opposite side portions of said larger sheet adjacent said opposite sides of said panel, in semi-rigid fashion, a central perforation shaped and sized to receive a horseshoe stake, an equally shaped and sized cutout in each of said side portions at a medial position adjacent the perimetral edge thereof, said second mat being sufficiently smaller than said first mat to permit superimposure of said second mat over said first mat and to permit turning the opposite end portions of said larger sheet adjacent said ends of said smaller sheet of each of said mats upward and inward and to permit raising said side portions of said mats to form a single carrying bag.

2. The device of claim 1 wherein said mats can also be converted into two separate carrying bags.

3. The mats of claim 1 further including an elongate pin projecting from the lower surface of one of said end portions of each of said mats in perpendicular relationship to said end portion, at medial position adjacent the distal end thereof, to anchor said mats to the ground.

4. The mats of claim 3 wherein said end portions opposite said pins include a plurality of smaller perforations located medially in spaced apart relationship to receive said pin.

5. The mats of claim 4 wherein said pin comprises a perimetral groove to engage a section of the perimetral edge of one of said smaller perforations.

* * * * *